US005452854A

United States Patent [19]

Keller

[11] Patent Number: 5,452,854

[45] Date of Patent: Sep. 26, 1995

[54] PLASMA SPRAY APPARATUS

[75] Inventor: Silvano Keller, Böttstein, Switzerland

[73] Assignee: Plasma-Technik AG, Wohlen, Switzerland

[21] Appl. No.: 158,964

[22] Filed: Nov. 29, 1993

[30] Foreign Application Priority Data

Dec. 5, 1992 [DE] Germany ..... 42 40 991.8

[51] Int. Cl.[6] ..... H05H 1/34; H05H 1/42; B05B 7/22

[52] U.S. Cl. ..... 239/80; 219/76.16; 219/121.47; 219/121.48; 239/85; 239/132.3; 239/263.1; 239/263.3; 239/587.5

[58] Field of Search ..... 239/79, 80, 85, 239/132, 132.3, 247, 263.1, 263.3, 587.1, 587.5; 219/76.16, 121.47, 121.52, 121.48

[56] References Cited

U.S. PATENT DOCUMENTS

| | | | |
|---|---|---|---|
| 4,201,341 | 5/1980 | Huhne et al. | 239/79 |
| 4,462,548 | 7/1984 | Egli | 239/263.3 |
| 4,843,208 | 6/1989 | French et al. | 219/121.52 |
| 4,877,937 | 10/1989 | Müller | 219/76.16 |
| 4,912,296 | 3/1990 | Schlienger | 219/121.52 |
| 4,970,364 | 11/1990 | Müller | 219/121.48 |
| 5,328,516 | 7/1994 | Dietiker | 219/121.48 |

FOREIGN PATENT DOCUMENTS

| | | | |
|---|---|---|---|
| 0223544 | 9/1962 | Austria | 239/587.5 |
| 3301548 | 10/1986 | Germany . | |
| 4002808 | 8/1991 | Germany . | |
| 0187573 | 8/1987 | Japan | 219/76.16 |
| 1636151 | 3/1991 | U.S.S.R. | 219/76.16 |
| WO9008203 | 7/1990 | WIPO . | |

*Primary Examiner*—Andres Kashnikow
*Attorney, Agent, or Firm*—Tarolli, Sundheim & Covell

[57] ABSTRACT

The plasma spray apparatus for the coating of the inner walls of bores and tubes essentially comprises a housing, a supply member, a plasma gun shaft member and a plasma gun head member. The plasma torch created in the head member escapes transversely with regard to the central longitudinal axis of the plasma spray apparatus. The supply member is rotatably received in the interior of the housing and is driven by an electric motor and a gear box. The supply member comprises a swiveling coupling member by means of which the plasma gun shaft member is connected to the shaft member. Thus, the rotatable shaft member can be radially deflected with reference to the axis of rotation. Thus, the head member fixed to the free end of the shaft member can be radially adjusted. With such a plasma spray apparatus, bores and tubes having greatly varying inner diameters can be reliably coated.

24 Claims, 4 Drawing Sheets

PLASMA SPRAY APPARATUS

FIELD OF THE INVENTION

The present invention refers to a plasma spray apparatus for coating the inner walls of bores or tubes.

Plasma spray apparatuses are widely used for applying a coating onto the surface of workpieces which are under heavy thermal and/or mechanical stress. Thereby, a suitable material, e.g. a ceramics material or a metal alloy, is molten in a plasma torch generated by a plasma gun and applied to the surface to be coated with the help of a high velocity gas stream. As long as the surface to be coated is readily accessible from the outside, it can be coated with a commonly used plasma spray apparatus. However, if the inner walls of bores or tubes have to be coated, certain problems arise. If such an inner wall is coated by means of a plasma spray apparatus having a plasma torch escaping from the plasma gun in axial direction, the coating operation is most inefficient since only a very small portion of the molten coating material is effectively applied onto the wall.

In order to apply a coating onto the inner walls of tubes and bores in a more efficient manner, one was forced to operate the plasma gun with a deflected torch, i.e. a torch escaping from the plasma gun head member under a certain angle with regard to the central longitudinal axis. However, two disadvantages must be considered: (i) In practice, only small deflection angles in the region of not more than appr. 30°–40° can be achieved. (ii) If the plasma gun head member is operated with a deflected torch, considerably increased wear, particularly of the anode assembly of the plasma gun head member, must be taken into account.

According to common practice, in order to coat the inner wall of a tube or bore, the plasma gun head member is introduced into the interior of the bore or tube to be coated and the workpiece is rotated such that the axis of rotation of the workpiece coincides with the central longitudinal axis of the plasma spray apparatus. Thus, it is ensured that the inner wall of the bore or tube is evenly coated over its entire surface.

However, in the case when inner walls of bores in a large workpiece or e.g. inner walls of fixedly mounted tubes are to be coated, the workpieces cannot be rotated around the plasma gun head member in order to apply a coating.

PRIOR ART

The publication WO 90/08203 discloses a method and an apparatus for applying a metallic coating, particularly onto cylinder walls. The apparatus comprises a centrally located electrode in the shape of an endless wire which has to be molten. The apparatus further comprises an arm member rotatable around the electrode to be molten which has fixed to its end a head member incorporating a gas nozzle and a non-meltable electrode. In order to apply a coating onto a cylindrical wall, the non-meltable electrode rotates around the electrode to be molten whereby an electric arc is created between the two electrodes. The endless wire is molten in the electric arc and, simultaneously, an atomizing gas escapes from the aforementioned nozzle which flows around the electric arc in a direction transverse to the longitudinal axis of the apparatus. Thereby, the molten metal is blown against the cylindrical wall to be coated, suspended in the form of very small particles and deposited on the cylindrical wall. Due to the rotation of the non-meltable electrode with the escaping gas around the meltable electrode, the cylindrical wall is coated on its entire circumference.

A disadvantage of such a design is that only materials can be applied which have a relatively low melting point. Moreover, the diameters of different cylindrical walls to be coated can vary only within small limits as the maximal length of the path the molten metal particles can pass along is quite small. Due to the relatively large diameter of the rotating head, the minimal diameter of a bore or tube whose inner wall has to be coated is considerably large.

A rotatable plasma spray apparatus is disclosed in the German Published Patent Application Nr. 40 02 808. This plasma spray apparatus comprises an axially aligned nozzle assembly located at the end of a hollow shaft and having an axially escaping plasma torch. The hollow shaft is rotatably received in a sleeve member fixedly coupled to a support member. In order to drive the hollow shaft to a rotational movement, there is provided an electric motor which is coupled via a belt pulley to the hollow shaft. The object to be achieved with such a design is, by the provision of a rotatable nozzle assembly, to prevent as far as possible the occurrence of double torches or at least a damage of the nozzle assembly. Such a plasma spray apparatus can be used only as a heat source for melting different materials. A coating of the inner walls of cylindrical bores or tubes is not possible with such an apparatus.

The German Patent Specification Nr. 33 01 548 discloses a further spray apparatus designated as spray coating device. It is said that it should be suitable both for flame spraying and for plasma spraying. This spraying device comprises a rotatable arm member received in a frame and being designed as a double linkage lever. One end thereof is provided with a spraying gun and the other end with a counterweight. The aforementioned frame, together with the rotatable arm, is linearly displaceable in a bore. The rotatable arm is driven by an electric motor mounted to the frame. The supply tubes required for the operation of the spraying gun are coupled to the rotatable arm via a rotating coupling member. A disadvantage of this design is that the entire apparatus has to be inserted into the bore or tube to be coated, with the result that the spray apparatus is under an extremely high thermal stress. Particularly, the entire spray apparatus and even more particularly the rotating parts thereof are exposed to the spraying particles and to the dust. Moreover, such a design of a spraying apparatus is suitable only for bores or tubes having quite a large diameter.

Furthermore, designs of plasma spray apparatuses and flame spray apparatuses are known in the art which have a rotatable spray or plasma gun head member in which the spraying jet or plasma torch is deflected in radial direction. A disadvantage of such a design is that the rotating parts and bearings thereof are located very close to the hot spray jet or plasma torch and that these sensitive elements are subjected to heavy contamination. Such apparatuses usually cannot be operated during an extended period of time without a great expenditure in maintenance (periodical disassembling and cleaning). Moreover, it must be noted that it is not possible to coat the inner wall of bores and tubes having different diameters with a spray apparatus having but a rotatable head. A deflected plasma torch further has the disadvantage that grooves or collars in the interior of a tube or bore cannot be coated homogeneously. Additionally, with a deflected plasma torch, the danger of abrasion and deposits of molten coating material at the plasma gun head must be considered.

Finally, as already mentioned, the plasma torch cannot be deflected by 90° as would be most desirable; realistic and usual are deflection angles between 10° and 40°. Generally, it can be said, that a deflection of a gas stream, in contrary to the deflection of a plasma torch, presents absolute no difficulties.

OBJECTS OF THE INVENTION

Thus, it is an object of the invention to provide a plasma spray apparatus for the coating of the inner walls of bores and tubes which shows a better efficiency as the plasma spray apparatuses known in the art.

It is a further object of the invention to provide a plasma spray apparatus for the coating of the inner walls of bores and tubes which allows for coating of bores and tubes having different diameters with the same apparatus.

It is a still further object of the invention to provide a plasma spray apparatus for the coating of the inner walls of bores and tubes with which the walls of bores and tubes can be homogeneously coated, even if grooves or protruding collars or the like are present in the interior of the tube or bore.

SUMMARY OF THE INVENTION

To achieve these and other objects, the invention provides a plasma spray apparatus for coating the inner walls of bores and tubes, comprising a supply member having a central longitudinal axis and adapted to be connected to a source of electric energy and of powdery, liquid and gaseous media required for the operation of the plasma spray apparatus. There is provided a plasma gun shaft member having a first and a second end, whereby the first end is connected to the supply member at one longitudinal end thereof, and a plasma gun head member connected to the second end of the plasma gun shaft member.

The apparatus of the invention further comprises a housing and bearing means located in the interior of the housing for receiving the supply member to be rotatable, together with the plasma gun shaft member and the plasma gun head member, around the central longitudinal axis.

Driving means located in the housing are provided for driving the supply member and thereby the plasma gun shaft member and the plasma gun head member to a rotational motion around the central longitudinal axis.

The plasma gun head member is adapted to create a plasma torch escaping from the plasma gun head member in a direction running transverse to the central longitudinal axis.

With a plasma spray apparatus having a rotatable supply member, a plasma gun shaft member connected thereto and a plasma gun head member fixed to the end of the plasma gun shaft member with a transversely escaping plasma torch, only the plasma gun shaft member and the plasma gun head member has to be introduced into the bore or tube whose walls are to be coated. Thereby, even walls of small bores and tubes can be reliably coated. Due to the transversely, essentially radially escaping plasma torch, a high efficiency can be achieved and grooves, protruding collars and the like can be homogeneously coated.

In a preferred embodiment of the plasma spray apparatus of the invention, the supply member comprises a swiveling coupling member, the first end of the plasma gun shaft member being connected to the swiveling coupling member for adjusting the radial position of the plasma gun head member. Thus, the possibility is given that bores and tubes having a greatly different inner diameter can be coated with one and the same plasma spray apparatus. The same is true for a design where there is provided a sliding coupling member for connecting the shaft member.

According to a further embodiment, there is provided at least one rotational coupling member adapted to transport the electrical energy required for the operation of the plasma spray apparatus from the source of electric energy to the rotatable supply member. The rotational coupling member comprises two collector rings and two groups each incorporating four pairs of brushes which are located correspondingly to cooperate with the collector rings. With this design, a reliable power supply to the plasma gun head member is ensured, even if the rotatable parts of the apparatus vibrate because always more than one brush contacts the collector rings.

According to a still further embodiment, the supply member is composed of a plurality of individual segments. Such a supply member is much easier to manufacture, particularly if it is provided channel with means for the transport of operating media for the plasma gun head member, which run through the interior of the supply member and connect the rotational coupling members with the plasma gun shaft member. Otherwise, these channels could be manufactured only with correspondingly high expenditure in a one-piece supply member. Moreover, a multi-piece supply member can be cleaned and repaired much easier.

BRIEF DESCRIPTION OF THE DRAWINGS

In the following, two embodiments of the plasma spray apparatus according to the invention will be further described, with reference to the accompanying drawings, in which.

DETAILED DESCRIPTION OF THE PREFERRED EMBODIMENTS

Figure 1:
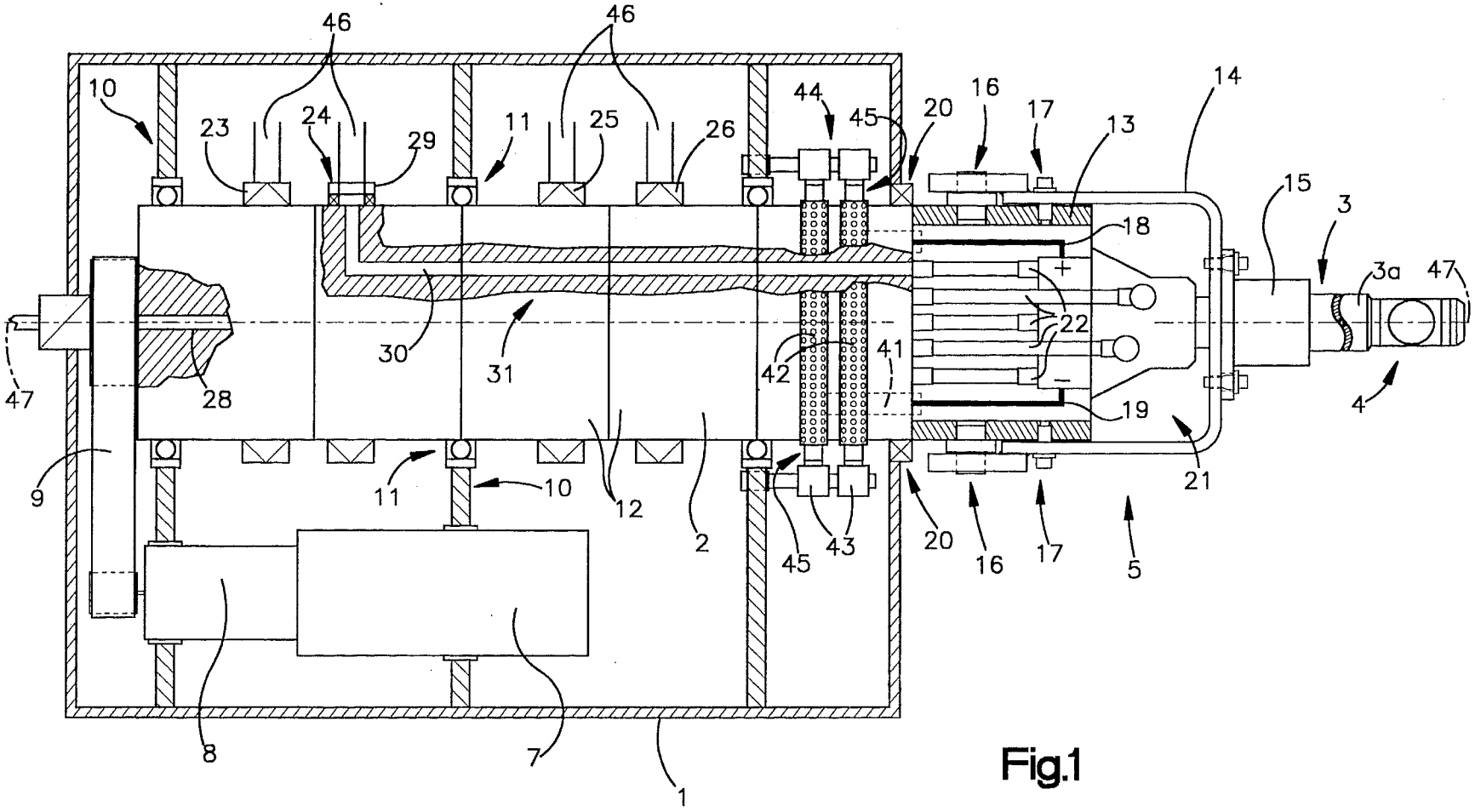
FIG. 1 shows a schematic, partially sectioned view of a first embodiment of the plasma spray apparatus having a radially swivelable plasma gun shaft member.

FIG. 1 shows a schematic partially sectioned view of a first embodiment of the plasma spray apparatus according to the invention. With the aid of this strongly simplified drawing, the general basic design and the operation of this plasma spray apparatus will be further explained. Further details which are important in connection with the invention will be explained later with the aid of further drawing figures.

The essential parts of the plasma spray apparatus are a housing 1, a supply member 2, a plasma gun shaft member 3, a plasma gun head member 4, a swiveling coupling member 5 as well as a driving motor 7 with a gear box 8. The plasma gun shaft member 3 is broken by a line x whereby an end portion 3*a* of the shaft member 3 with the plasma gun head member 4 mounted at the end thereof is shown somewhat offset. In the interior of the housing 1, there are provided three supporting plate members 10. The supply member 2 is received in the interior of the housing 1 and held by these three supporting plate members 10 by means of bearings 11 to be rotatable around a central axis 47. Thus, the housing 1 may be regarded as a stator and the supply member 2 as a rotor.

The supply member 2 is of modular design and comprises a plurality of individual segments 12 which are connected to each other by means of (not shown) screws. Connected to two of the three supporting plate members 10 is the driving motor 7 and the gearbox 8. The power transmission from the driving motor 7 to the supply member 2 is accomplished by means of the gearbox 8 and a toothed belt 9 coupling the output shaft of the gearbox 8 and the supply member 2. In order to seal the interior of the housing 1 against dust and particularly against plasma coating powder, the housing 1 is provided with an annular sealing member 20 located at the end close to the plasma gun shaft member 3 and inserted between the housing 1 and the rotatable supply member 2.

The frontal end of the supply member 2 is provided with a swiveling coupling member 5 which serves for connecting the plasma gun shaft member 3 to the supply member 2. This swiveling coupling member 5 comprises, in this embodiment, a U-shaped shackle member 14 which is connected to a tubular extension member 13 of the supply member 2 by means of two hinge members 16 and four locking screws 17. However, in FIG. 1, only two of the four locking screws 17 are evident. The plasma gun shaft member 3 is connected to the swiveling coupling member 5 by means of a tubular sleeve 15 provided at the front end of the swiveling coupling member 5 and surrounding the plasma gun shaft member 3.

In order to transport the media required for the operation of the plasma spray apparatus from the stationary housing 1 to the rotating supply member 2, four rotational coupling members 23, 24, 25 and 26 are provided and radially located around the supply member 2. The rotational coupling member 24, thereby, is shown in a partially sectioned view, while the remaining rotational coupling members 23, 25 and 26 are purely schematically shown. The two rotational coupling members 23 and 24 serve for the supply and the draining, respectively, of cooling liquid required for the cooling of the plasma gun shaft member 3, 3*a* and the plasma gun head member 4. The two rotational coupling members 25 and 26 serve for the supply of plasma gas and air, respectively, required for the operation of the plasma spray apparatus. It is understood that the supply of one or the other one of the media may be accomplished via more than one rotational coupling member. The supply pipes 46 leading to the rotational coupling members 23, 24, 25 and 26 are only partially shown in the interior of the housing 1.

The apparatus shown in FIG. 1 further comprises a rotational coupling member 27 for feeding plasma coating powder, located at the back end of the supply member 2 in coaxial relationship thereto. Assigned to each of the rotational coupling members 23, 24, 25 and 26 is an annular channel 29 surrounding the supply member 2. Into the annular channels 29 merges in each case a channel leading through the interior of the supply member 2. Even if four such channels are present in the embodiment shown in FIG. 1, only one channel 30 is shown for the sake of clarity. In order to clearly show the course of this channel 30, the supply member 2 is shown in a partially sectioned view 31 in the region of this channel 30. Thus, it can be seen that the channel 30 leads, starting from the annular channel 29, in radial direction into the supply member 2, is deviated by 90° and further runs in longitudinal direction through the interior of the supply member 2 to the end thereof which is close to the plasma gun shaft member 3.

The supply member 2 is provided with a straight central bore 28 running from the axially located rotational coupling member 27 through the supply member 2 for the supply of the plasma coating powder. Preferably, the plasma coating powder is fed with the aid of a carrier gas. Since plasma coating powder can have an abrasive effect, it is important that the central bore 28 runs straight through the supply member 2 without bends or corners.

At the end of the supply member 2 close to the plasma gun shaft member 3, the bores and channels 28 and 30, respectively, open into flexible supply pipes 22. These flexible supply pipes 22 lead to a connecting piece 21 which is located at the end of the supply member 2 close to the plasma gun shaft member 3.

The transfer of the electric energy required for the operation of the plasma spray apparatus from the housing 1 to the supply member 2 is accomplished by means of an electric rotational coupling member 44 comprising two collector rings 42 located on the supply member 2 and two groups 43 of pairs of brushes 45 which are arranged in corresponding relationship to the collector rings 42. Starting at the said collector rings 42, copper rails 41 lead through the interior of the supply member 2 to the end thereof close to the plasma gun shaft member 3. Each copper rail 41 is electrically connected to one of the collector rings 42. At both ends of these copper rails 41, electric wires 18, 19 are connected which lead to the connecting piece 21.

In the region of the brush pairs 45, tube members are provided, the opening thereof being directed towards the individual brushes. By means of these tube members, pressurized air can be blown in to prevent that leakage currents or short circuits may occur between the individual brushes due to dust generated by the wearing-out of the brushes. For the sake of clarity, these tubes are not shown in the drawings.

Through the uppermost of the flexible supply pipes 22, cooling liquid is conducted from the supply member 2 to the plasma gun shaft member 3. This cooling liquid flows through the plasma gun shaft member 3 and 3*a* to the plasma gun head member 4 and circulates around the latter one. Thereafter, the cooling liquid flows back through the plasma gun shaft member 3 and through the lowermost flexible pipe 22 back to the supply member 2. In the interior of the connecting piece 21, one of the electric wires 18 is electrically connected to the cooling liquid supply pipe and the other electric wire 19 to the cooling liquid drainage pipe. Thus, the electric energy required for the operation of the plasma gun assembly is led to the plasma gun head member 4 via the cooling liquid pipes which preferably are made of copper. Thereby, it is understood, that the cooling liquid is not electrically conductive; advantageously, extremely pure water can be used as a cooling liquid.

The cooling liquid pipes running through the plasma gun shaft member 3 are designed such that they simultaneously cool the shaft member 3. Through the three centrally located flexible supply pipes 22, the remaining media required for the operating of the plasma spray apparatus are feed from the supply member 2 to the plasma gun shaft member 3, e.g. cooling air, plasma gas and plasma coating powder. The kind of feeding used to feed these media from the plasma gun shaft member 3*a* to the plasma gun head member 4 is well known in the art; this removes the need to further explain it here.

The plasma gun head member 4 comprises a plasmatron which is oriented in a direction extending radially to the central longitudinal axis of the plasma spray apparatus. Thus, the plasma torch is generated in a direction transverse to the central longitudinal axis of the plasma spray apparatus and, consequently, escapes from the plasmatron in the same transverse direction. Furthermore, the plasma gun head member 4 is provided with a plurality of apertures 48 opening to the outside in a direction transverse to the central longitudinal axis of the plasma gun shaft member 3. Through these apertures 48, cooling air is blown which helps to cool the walls of the bore to be coated and the coating applied thereon, respectively. Such a cooling is particularly important in the case where tube walls or bore walls are to be coated which have a diameter that is relatively small as compared to the diameter of the plasma gun head member 4. The operation of such a plasmatron is well known in the art and no further explanations appear to be necessary here.

Figure 2:
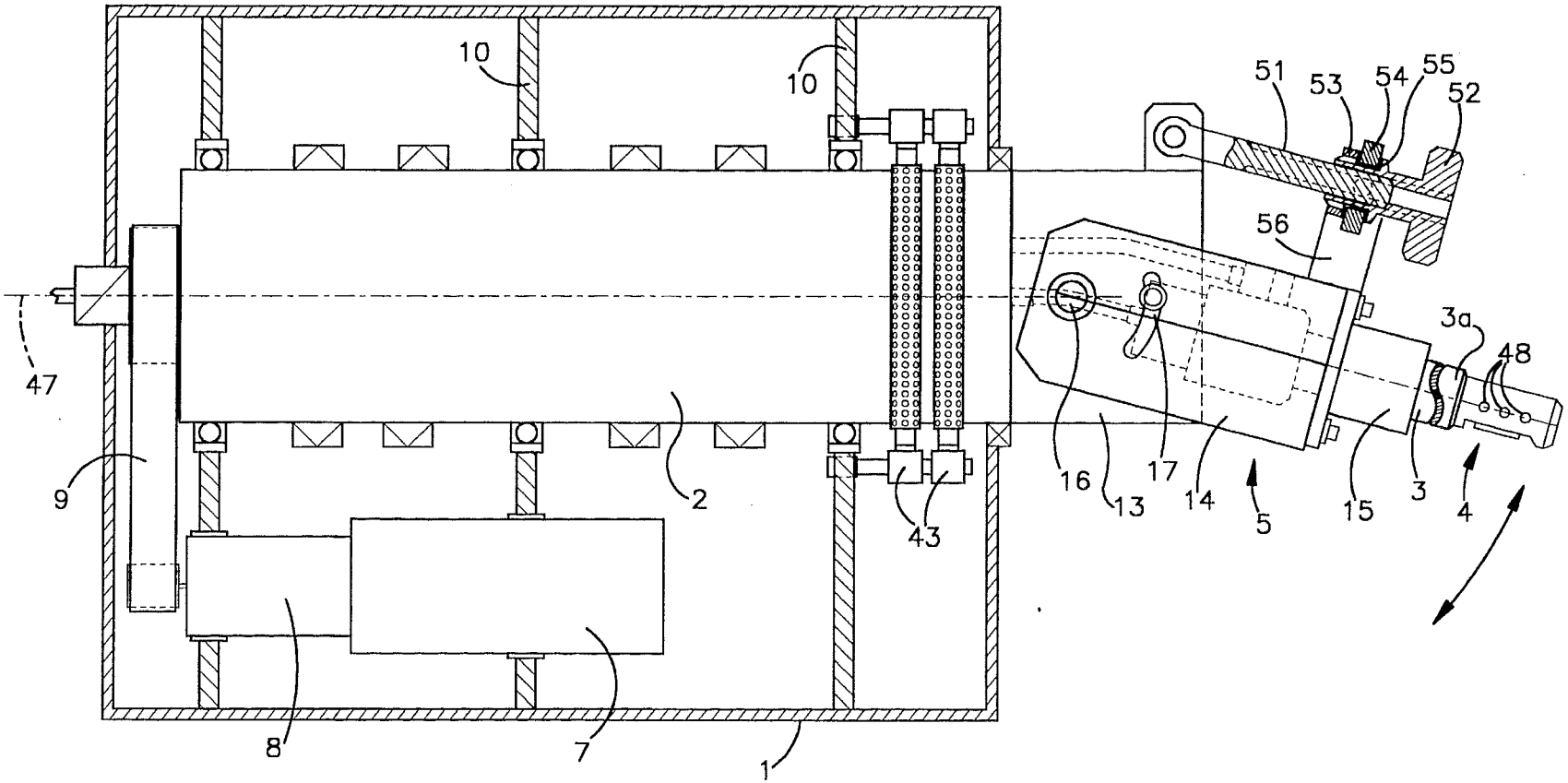
FIG. 2 shows a schematic, partially sectioned view of the first embodiment of the plasma spray apparatus with its plasma gun shaft member in a swiveled position.

In FIG. 2, the embodiment of the plasma spray apparatus according to FIG. 1 is shown again, in a even more simplified, partially sectioned view with the supply member 2 rotated, with reference to the view in FIG. 1, by 90° around its central longitudinal axis 47. Furthermore, the plasma gun shaft member 3, 3*a* is swiveled with regard to the central longitudinal axis 47 by about 15°. For this purpose, the shackle member 14 of the swiveling coupling member 5 was radially swiveled around the hinge 16 and fixed by means of the locking screws 17. In this view, moreover, the above mentioned apertures 48 are visible through which cooling air can escape.

In order to enable the shackle member 14 with the plasma gun shaft member 3, 3*a* to be radially swiveled, there is provided a manually operated mechanism. This mechanism essentially consists of a threaded bolt 51 which is rotatably mounted to the supply member 2 and of a knurled knob 52 screwed to the threaded bolt 51. The knurled knob 52 is provided with a collar 55 as well as with an annular member 53 screwedly fixed to the front end of the threaded bolt 51. The shackle member 14 is provided with an integral projection 56 which comprises an annular washer 54. The collar 55 and the annular member 53 of the knurled knob 52 engage with the annular washer 54 with the result that a positive engagement is created between the knurled knob 52 and the projection 56 and, thereby, between the supply member 2 and the shackle member 14. In this manner, the deflection of the plasma gun shaft member 3, 3*a* can be varied by rotating the knurled knob 52. Moreover, this mechanism serves for fixing the plasma gun shaft member 3, 3*a* and the shackle member 14 in the deflected position. The plasma gun shaft member 3, 3*a* can be deflected in two opposite directions according to the double arrow 32. If the plasma gun shaft member 3, 3*a* is deflected downwards, as seen in FIG. 2, the plasma gun head member 4 comes closer to the wall to be coated, while a deflection in upward direction, as seen in FIG. 2, moves the plasma gun head member 4 away from the surface to be coated. An upward deflection is most useful in the case of tubes with a small diameter have to be coated because the spraying distance can be increased in this way.

In order to monitor the degree of deflection of the plasma gun shaft member 3, 3*a*, there is provided a scale connected to the shackle member 14 and a pointer connected to the supply member 2. For the sake of clarity, both these elements are not shown in the drawing. In order to simplify a centering and aligning, respectively, of the plasma gun head member 4, there can be provided a laser beam source emitting a laser beam. Preferably, the laser beam source can be connected to the front end of the supply member 2 in a predetermined radial distance from the axis of rotation 47. Since such laser beam sources are well known in the art, it is not shown in the drawing.

If the plasma gun shaft member 3, 3*a* is swiveled by 15° with reference to the central axis 47, the plasma gun head member 4 mounted to the end of the plasma gun shaft member 3, 3*a* is radially displaced by an amount of appr. 270 mm with the plasma gun shaft member 3, 3*a* having a total length of appr. 1000 mm; thus, the walls of bores or tubes having a diameter of up to 550 mm can be coated.

Figure 3:
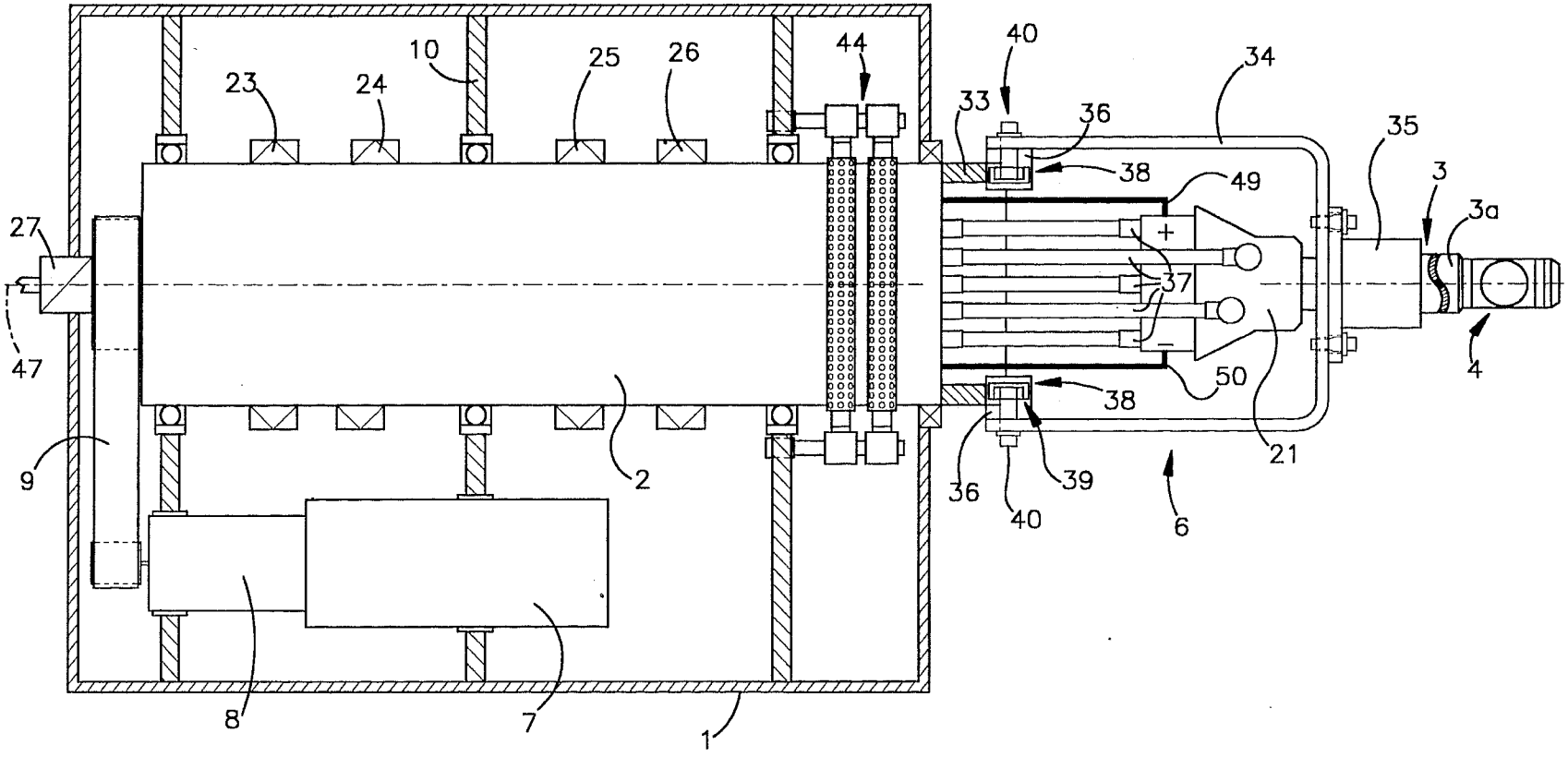
FIG. 3 shows a schematic, partially sectioned view of a second embodiment of the plasma spray apparatus having a radially shiftable plasma gun shaft member.

In FIG. 3, there is shown a second embodiment of the plasma spray apparatus having a radially adjustable plasma gun shaft member 3, 3*a* in a schematic, partially sectioned view. The essential difference between this second embodiment and the first embodiment shown in FIGS. 1 and 2 is the mounting of the plasma gun shaft member 3, 3*a* on the supply member 2; in the second embodiment, there is provided a sliding coupling member 6 for this purpose. Since the remaining parts and elements of the plasma spray apparatus according to the second embodiment are essentially identical to those of the first embodiment, in the following only the sliding coupling member 6 replacing the swiveling coupling member 5 of the first embodiment will be described in detail.

Again, the sliding coupling member 6 comprises a shackle member 34. Connected to the tube-shaped projection member 33 of the supply member 2 are two rails 36 each comprising a T-shaped guiding groove 38. Two connecting nuts 39 are received in these guiding grooves 38, and the shackle member 34 is connected thereto by means of four locking screws 40. It is understood that in FIG. 3 only two of the locking screws 40 and of the connecting nuts 39 are visible.

Similarly, the plasma gun shaft member 3 is connected to the sliding coupling member 6 by means of a tubular sleeve 35 provided at the front portion of the sliding coupling member 6 and surrounding the plasma gun shaft member 3. In order to provide for a radial displacement of the plasma gun shaft member 3, 3*a* with reference to the central axis of rotation 47, the shackle member 34 and, thereby, the plasma gun shaft member 3, 3*a* with the plasma gun head member 4 connected to its end can be slid along the guiding grooves 38 an locked at every desired position of the rails 36 by tightening the locking screws 40. The flexible supply tubes 37 for the plasma spray apparatus media and the wires 49, 50 for supplying electrical energy end at the rear portion of the plasma gun shaft member 3 at the connecting piece 21.

Figure 4:
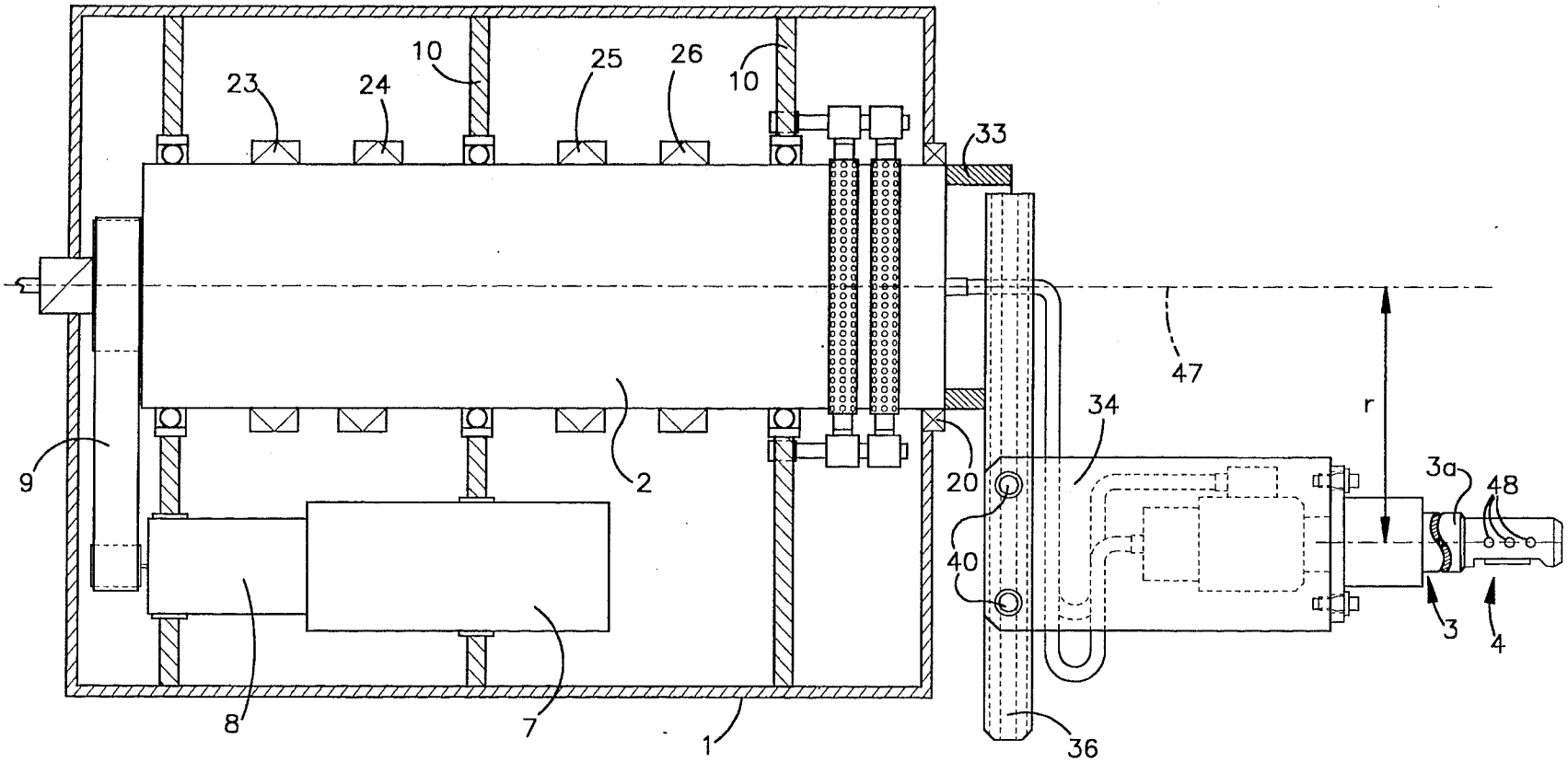
FIG. 4 shows a schematic, partially sectioned view of the second embodiment of the plasma spray apparatus with its plasma gun shaft member in a radially shifted position.

FIG. 4 shows a schematic view of the plasma spray apparatus according to FIG. 3 with the supply member, the plasma gun shaft member 3, 3*a* and the plasma gun head member 4 rotated by 90°. Moreover, the plasma gun shaft member 3, 3*a* is radially displaced with reference to the axis of rotation 47 of the supply member. For this purpose, the shackle member 34 of the sliding coupling member 6 has been displaced along the two guiding rails 36 and fixed in its displaced position by means of the locking screws 40. If the supply member 2 is driven to a rotational movement under the influence of the driving motor 7, the plasma gun head member 4 conducts an annular motion with a radius r. In this way, by radially displacing the shackle member 34 together with the plasma gun shaft member 3, 3*a* and the plasma gun head member 4, the walls of tubes or bores with different diameters can be coated. In this connection, it can be useful to provide a toothing which is located on both sides of the shackle member 34 and corresponding between the shackle member 34 and the rails 36 in order to ensure that the centrifugal forces occurring during the rotation of the plasma gun shaft member 3, 3*a* and the plasma gun head member 4 do not effect an undesired radial displacement of the shackle member If the plasma gun shaft member 3, 3*a* and the plasma gun head member 4 are aligned such that their longitudinal axes coincide with the axis of rotation 47, walls of tubes or bores can be coated which have a diameter which is only slightly bigger than the diameters of the plasma gun head member or the plasma gun shaft member. In order to compensate for the centrifugal forces occurring during the operation of the plasma spray apparatus with radially deflected plasma gun shaft member particularly in the region of the transition from the sliding coupling member 6 to the supply member 2, the supply member 2 or the sliding coupling member 6 can be provided with counterweights (not shown in the drawing).

The two embodiments of the plasma spray apparatus hereinbefore described each comprise a plasma gun shaft member and a plasma gun head member which can be radially displaced with reference to the axis of rotation of the plasma spray apparatus. Common to both embodiments is that the mechanism for the displacement of the plasma gun head member is remotely located from the plasma torch; thus, this mechanism is subjected only to a relatively low temperature and dust load. Consequently, such a plasma spray apparatus ensures a reliable operation even under heavy environmental conditions.

The plasma torch escaping transversely from the plasma gun head member moreover ensures a high efficiency of the plasma spray apparatus with regard to the molten and finally applied coating material.

What is claimed is:

1. A plasma spray apparatus for coating the inner walls of bores and tubes, comprising:

a supply member having a central longitudinal axis and adapted to be connected to a source of electric energy and of powdery, liquid and gaseous media required for the operation of the plasma spray apparatus;

a plasma gun shaft member having a first and a second end, said first end being connected to said supply member at one longitudinal end thereof;

a plasma gun head member connected to said second end of said plasma gun shaft member;

a housing means;

bearing means located in the interior of said housing means for receiving said supply member to be rotatable, together with said plasma gun shaft member and said plasma gun head member, around said central longitudinal axis;

driving means located in said housing for driving said supply member and thereby said plasma gun shaft member and said plasma gun head member to a rotational motion around said central longitudinal axis;

said plasma gun head member being adapted to create a plasma torch escaping from said plasma gun head member in a direction running transverse to said central longitudinal axis; and means for adjusting the radial position of said plasma gun head member relative to said central longitudinal axis of said supply member.

2. A plasma spray apparatus according to claim 1 in which the central axis of said plasma torch escaping from said plasma gun head member includes an angle of at least 30° with said central longitudinal axis.

3. A plasma spray apparatus according to claim 1 in which the central axis of said plasma torch escaping from said plasma gun head member includes an angle of between 45° and 90° with said central longitudinal axis.

4. A plasma spray apparatus according to claim 1 in which said plasma gun head member is radially adjustable with regard to said central longitudinal axis.

5. A plasma spray apparatus according to claim 1 in which said supply member comprises a swiveling coupling means, said first end of said plasma gun shaft member being connected to said swiveling coupling means for adjusting the radial position of said plasma gun head member.

6. A plasma spray apparatus according to claim 1 in which said supply member comprises a sliding coupling means, said first end of said plasma gun shaft member being connected to said sliding coupling means for adjusting the radial position of said plasma gun head member.

7. A plasma spray apparatus according to claim 5 in which said swiveling coupling means comprises a shackle member and a tubular sleeve member surrounding said plasma gun shaft member and being connected to said shackle member.

8. A plasma spray apparatus according to claim 5 in which said swiveling coupling means comprises two hinge means for swivelably receiving said plasma gun shaft member and four lock screw means for locking the position of the swiveled plasma gun shaft member.

9. A plasma spray apparatus according to claim 6 in which said sliding coupling means comprises a shackle member and a tubular sleeve member surrounding said plasma gun shaft member and being connected to said shackle member.

10. A plasma spray apparatus according to claim 6 in which said sliding coupling means comprises two rail means each having a guiding groove for a radial displacement of said plasma gun shaft member and four locking screw means for locking the radially displaced plasma gun shaft member.

11. A plasma spray apparatus according to claim 1 in which said housing means comprises a plurality of rotational coupling members adapted to transport the powdery, liquid and gaseous media required for the operation of the plasma spray apparatus from said source of powdery, liquid and gaseous media to said rotatable supply member.

12. A plasma spray apparatus according to claim 11 in which the rotational coupling members for the transport of water, air and plasma gas from the corresponding source to said rotatable supply member are radially located with regard to said supply member, while the rotational coupling member for the transport of plasma powder from the corresponding source to said rotatable supply member is axially located with regard to said supply member.

13. A plasma spray apparatus according to claim 11 in which said supply member is provided with channel means for the transport of operating media for the plasma gun head member, said channel means running through the interior of said supply member and connecting said rotational coupling members with said plasma gun shaft member.

14. A plasma spray apparatus according to claim 11 in which said supply member is provided with a central longitudinal straight channel for the transport of plasma powder, said channel running through the interior of said supply member and connecting said axially located rotational coupling member with said plasma gun shaft member.

15. A plasma spray apparatus according to claim 1 in which said housing means comprises at least one rotational coupling member adapted to transport the electrical energy required for the operation of the plasma spray apparatus from said source of electric energy to said rotatable supply member.

16. A plasma spray apparatus according to claim 15 in which said at least one rotational coupling member comprises two collector rings and two groups each incorporating four pairs of brushes which are located correspondingly to cooperate with said collector rings.

17. A plasma spray apparatus according to claim 1 in which said supply member and said plasma gun shaft member are interconnected by a plurality of flexible tubes and wires for transporting all media and the energy required for the operation of the plasma spray apparatus from said supply member to said plasma gun shaft member.

18. A plasma spray apparatus according to claim 1 in which said driving means comprises an electric motor, a gear box means driven by said electric motor and a toothed belt coupling said gear box means with said supply member.

19. A plasma spray apparatus according to claim 1 in which said housing means comprises a sealing means located between the end wall of said housing means which is close to said plasma gun shaft member and said rotating supply member.

20. A plasma spray apparatus according to claim 1 in which said supply member is composed of a plurality of individual segments.

21. A plasma spray apparatus according to claim 1 in which said plasma gun shaft member and said plasma gun head member are water-cooled.

22. A plasma spray apparatus according to claim 21 in which said plasma gun shaft member and said plasma gun head member are provided with copper tubes for the supply and the draining of cooling water, said copper tubes simultaneously serving as electric conductors for the supply of electric energy to said plasma gun head member.

23. A plasma spray apparatus according to claim 1 in which said plasma gun head member is provided with a plurality of apertures serving for the outlet of a cooling medium, for cooling the substrate to be coated, said apertures running in a direction transverse to the central longitudinal axis of said plasma gun shaft member.

24. A plasma spray apparatus according to claim 1 in which counterweights are provided for the compensation of centrifugal forces occurring during the rotation of the deflected plasma gun shaft member.

* * * * *